US006608982B2

(12) United States Patent
Shin et al.

(10) Patent No.: US 6,608,982 B2
(45) Date of Patent: Aug. 19, 2003

(54) DRYING UNIT FOR LIQUID ELECTROPHOTOGRAPHIC PRINTING APPARATUS AND LIQUID CARRIER DRYING METHOD USING THE SAME

(75) Inventors: Seong-soo Shin, Yongin (KR); Hyun-goo Woo, Seoul (KR); Won-seok Lee, Anyang (KR); Jae-myoung Choi, Suwon (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/854,917

(22) Filed: May 15, 2001

(65) Prior Publication Data

US 2002/0028090 A1 Mar. 7, 2002

(30) Foreign Application Priority Data

Sep. 4, 2000 (KR) ..... 2000-52207
Jan. 22, 2001 (KR) ..... 2001-3585

(51) Int. Cl.[7] ..... G03G 15/11
(52) U.S. Cl. ..... 399/251
(58) Field of Search ..... 399/250, 251

(56) References Cited

U.S. PATENT DOCUMENTS

| | | | | |
|---|---|---|---|---|
| 5,781,834 A | * | 7/1998 | Teschendorf et al. | 399/249 |
| 5,841,456 A | * | 11/1998 | Takei et al. | 347/103 |
| 5,884,128 A | * | 3/1999 | Park | 399/250 |
| 6,085,055 A | * | 7/2000 | Shin et al. | 399/250 |
| 6,141,518 A | * | 10/2000 | Shin et al. | 399/250 |
| 2001/0017997 A1 | * | 8/2001 | Saitoh | 399/250 |

FOREIGN PATENT DOCUMENTS

| | | |
|---|---|---|
| JP | 4-1774 | 1/1992 |
| JP | 8-190276 | 7/1996 |
| JP | 11-327402 | * 11/1999 |
| JP | 2000-500590 | 1/2000 |
| JP | 2000-293041 | 10/2000 |

* cited by examiner

*Primary Examiner*—Quana M. Grainger
(74) *Attorney, Agent, or Firm*—Sughrue Mion, PLLC

(57) ABSTRACT

A drying unit and method of drying for a liquid electrophotographic printing apparatus, the drying unit that is equipped in the printing apparatus comprising a developing unit that develops an image on an photosensitive medium using a liquid carrier as a mediator and a transfer unit that transcribes the developed image on a printing paper, so that the liquid carrier remaining on the photosensitive medium can be dried. The drying unit for the liquid electrophotographic printing apparatus is positioned near the photosensitive medium and includes a manifold having an inlet and an outlet; an inlet-outlet channel being between the inlet and the outlet and connecting them; a gas flowing unit by which the gas in the manifold is discharged through the outlet and gas flows in the manifold through the inlet; a condenser that condenses the evaporated carrier discharged through the outlet; and a heater that heats the gases flowing in the manifold through the inlet. Also, the liquid carrier drying method includes determining the injection condition; heating injection air according to the determined gas injection condition and evaporating the carrier on the photosensitive medium by injecting the heated gas at a predetermined speed in the manifold; discharging out of the manifold the carrier evaporated from the photosensitive medium and the air flowing in; and condensing the evaporated carrier at the manifold, of reheating the gas that is not condensed, injecting the gas at a predetermined speed into the manifold.

24 Claims, 9 Drawing Sheets

DRYING UNIT FOR LIQUID ELECTROPHOTOGRAPHIC PRINTING APPARATUS AND LIQUID CARRIER DRYING METHOD USING THE SAME

This application is a complete application filed under 35 U.S.C. §1.111(*a*) and claims pursuant to 35 U.S.C. §119(a), the date of Korean Patent Nos. 2000-522007 and 2001-35005 filed on Sep. 4, 2000 and Jan. 22, 2001, respectively. The Korean Patent Nos. 2000-52207 and 2001-3585 are incorporated herein by reference.

BACKGROUND OF THE INVENTION

1. Field of the Invention

The present invention relates to a drying unit for a liquid electrophotographic printing apparatus that is used in printing on printing paper an image developed on a photosensitive medium using a liquid carrier as a mediator. Specifically, the drying unit of the present invention dries the carrier remaining in the photosensitive medium. Additionally, the present invention relates to a liquid carrier drying method using the same, and more particularly, to a drying unit for a liquid electrophotographic printing apparatus having the structure where a liquid carrier on the photosensitive medium can be dried in a non-contacting way.

2. Description of the Related Art

Generally, a liquid electrophotographic printing apparatus forms an electrostatic latent image on a photosensitive medium such as a photosensitive drum or a photosensitive belt and operates as an image forming unit that can obtain a desired image by developing the electrostatic latent image with a toner of certain colors and transferring it onto a printing paper.

With reference to FIG. 1, a general liquid electrophotographic printing apparatus scans laser beams using laser scanning units 21, 23, 25 and 27 and forms an electrostatic latent image on a photosensitive belt 11 circulating along a predetermined path, and develops the electrostatic latent image using developing units 30, 40, 50 and 60. Then, after a drying unit 70 dries the liquid carrier remaining on the photosensitive belt 11, a dried image is transferred from a transfer unit 80 onto a printing paper P, and is thus printed. The photosensitive belt 11 rotates by being wound around a driving roller 13, a transfer backup roller 15 and a steering roller 17.

Each of the developing units 30, 40, 50 and 60 on which a predetermined voltage is applied comprise developing rollers 31, 41, 51 and 61 that are positioned face to face while maintaining a developing gap G when developing the electrostatic latent image; injectors 33, 43, 53 and 63 that provide ink inside the developing gap G; and squeegee rollers 35, 45, 55 and 65 that are positioned on the photosensitive belt 11 in such a way that the belt is pressured. The developing units 30, 40, 50 and 60 make a film of an image developed on the photosensitive belt 11. The ink provided through the injectors 33, 43, 53 and 63 consists of a toner that forms a color image transferred on the printing paper and a liquid carrier that transfers the toner to a region where an electrostatic latent image of the photosensitive belt 11 is formed.

The drying unit 70 absorbs and evaporates the liquid carrier containing the image developed on the photosensitive belt 11, and the liquid carrier is then recycled by condensation and filtration. For this purpose, the drying unit 70 comprises a manifold 71, a drying roller 72, a regeneration roller 73, a heater 74, a ventilation channel 75, a condenser 76, a ventilation pump 77 and a filter 78. Also, the drying unit 70 comprises a pressing device (not shown) such that, according to various modes, i.e., a home mode, a printing mode and a standby mode, the drying roller 72 is selectively in or out of contact with the photosensitive belt at a predetermined pressure and the regeneration roller 73 is selectively in or out of contact with the drying roller 72.

The drying roller 72 is equipped in the manifold 71 and installed such that the drying roller can be in contact with the face where the image of the photosensitive belt 11 is formed by the pressing device. An absorbing layer 72*a* is equipped outside the perimeter of the drying roller 72 and the carrier remaining on the surface of the photosensitive belt 11 is absorbed through the absorbing layer 72*a*.

The regeneration roller 73 is equipped in the manifold 71 in such a way that it can be in contact with the drying roller 72, and inside is equipped with a heater 74 that heats the regeneration roller 73. The carrier absorbed in the absorbing layer 72*a* of the drying roller 72 is evaporated at the regeneration roller 73 heated by the heater 74. This evaporated carrier is discharged through the ventilation channel 75 connected to the manifold 71 by the pumping action of the ventilation pump 77. The condenser 76 is equipped on the ventilation channel 75 and condenses the carrier moving through the ventilation channel 75. Here, the condensed carrier is separated from the water that is condensed with the carrier and re-supplied to the developing units 30, 40, 50 and 60 through another supply channel (not shown). The carrier that is not condensed is discharged after being filtered by the filter 78.

Meanwhile, a discharging device 91 that irradiates lights and removes charges remaining in the photosensitive belt 11; a charging device 93 that charges up to a predetermined voltage after removing charges; and a plurality of topping chargers 94, 95 and 96 that elevate the surface voltage of the photosensitive belt 11 after developing each color are installed proximate to the photosensitive belt 11 of the liquid electrophotographic printing apparatus.

The transfer unit 80 is positioned, at an interval of the photosensitive belt 11, facing the transfer backup roller 15, and comprises a transfer roller 81 where an image I developed at the photosensitive belt 11 is transcribed and a fuser roller 83 that is positioned at an interval for the printing paper P facing the transfer roller 81, thus immobilizing the printing paper P. Here, the image transcribed on the transfer roller 81 is transcribed on the printing paper P supplied between the transfer roller 81 and the fuser roller 83.

In the prior liquid electrophotographic printing apparatus comprising as described above, the drying unit is structured such that the drying roller contacts with the photosensitive belt and absorbs the liquid carrier. Thus the contacting time at the work point of the photosensitive belt is short and this contacting time is not enough for absorbing the liquid carrier. Therefore the prior printing apparatus has a disadvantage of a low drying efficiency. In particular, since drying is not sufficient enough in continuous printing, it causes a bad transfer of the image on the printing paper. At the same time, due to the bad drying, the liquid carrier is absorbed in the transfer roller, which in turn cause wrinkles in the printing paper, which induces a jam in the printing paper.

Also, since the drying roller contacts with the region where the image on the photosensitive belt is formed, the quality of the image is badly affected by picking the image on the photosensitive belt. In addition, since the picked image remains in the drying roller and the regeneration roller and is transmitted back to the photosensitive belt, it thereby contaminates other images on the photosensitive belt.

Furthermore, since the drying unit is of the contact-type, abrasion and contamination make the drying unit have a limited lifetime after printing several ten thousands times. Therefore, since it should be replaced after this limited lifetime, the maintenance cost is excessively high.

SUMMARY OF THE INVENTION

The present invention is contrived after considering the problems described above, and it is an object of the present invention to provide a drying unit for a liquid electrophotographic printing apparatus such that a liquid carrier on a photosensitive belt is dried in a non-contacting way, and a liquid carrier drying method using the drying unit.

To achieve the above objective, a drying unit for a liquid electrophotographic printing apparatus of the present invention comprises a developing unit that develops an image on a photosensitive medium using a liquid carrier as a mediator and a transfer unit that transcribes the developed image on a printing paper, so that the liquid carrier remaining on the photosensitive medium can be dried. The drying unit comprises a manifold having at least one inlet which is positioned near the photosensitive medium and opposite to the photosensitive medium that is open and through which hot air flows in; at least one outlet through which the carrier evaporated from the photosensitive medium by the hot air flowing in is discharged; an inlet-outlet channel connecting the inlet to the outlet; a gas flowing means by which the gas in the manifold is discharged through the outlet and gas flows in the manifold through the inlet; a condenser that is positioned on the inlet-outlet channel and that condenses the evaporated carrier discharged through the outlet; and a heater that is located on the inlet-outlet channel and that heats the gases flowing in the manifold through the inlet.

Also, a drying unit for a liquid electrophotographic printing apparatus is provided that comprises a heating means that is installed in parallel to the running direction of the photosensitive belt, out of contact with the photosensitive belt and that generates heat in order to dry and evaporate the liquid carrier; a manifold that surrounds the heating means and that collects the gas carrier evaporated by the heating means; an inlet-outlet channel that forms the path for circular movement of the gas carrier collected in the manifold by forming a closed loop in communication with the manifold; at least one gas flowing means which is installed on the inlet-outlet channel that circulates the gas carrier along the inlet-outlet channel; an inlet duct which is installed through the manifold and through which the gas carrier evaporated by the heating means flows in communication with the inlet-outlet channel; and a ventilation duct which is installed in communication with the inlet-outlet channel so that air flows in the manifold.

In addition, to achieve the above objective, the invention provides a liquid carrier drying method using a drying unit for the liquid electrophotographic printing apparatus, the drying unit comprising a developing unit that develops an image on a photosensitive medium using a liquid carrier as a mediator and a transfer unit that transcribes the developed image on a printing paper, so that the liquid carrier remaining on the photosensitive medium can be dried. The drying method comprises the steps of calculating the amount of the liquid carrier on the photosensitive medium determining the air injection condition according to the calculated amount of the liquid carrier; heating injection air according to the determined condition and evaporating the carrier on the photosensitive medium by injecting the heated gas at a predetermined speed into the manifold positioned near the photosensitive medium with a surface facing the photosensitive medium and open; discharging out of the manifold the carrier evaporated from the photosensitive medium and the air flowing in through the inlet-outlet channel; condensing the evaporated carrier at the manifold; reheating the gas that remains uncondensed, and injecting the gas at a predetermined speed into the manifold.

BRIEF DESCRIPTION OF THE DRAWING(S)

The above objectives of the present invention will become more apparent by describing in detail preferred embodiments thereof with reference to the attached drawings in which.

DESCRIPTION OF THE PREFERRED EMBODIMENT(S)

Figure 2:
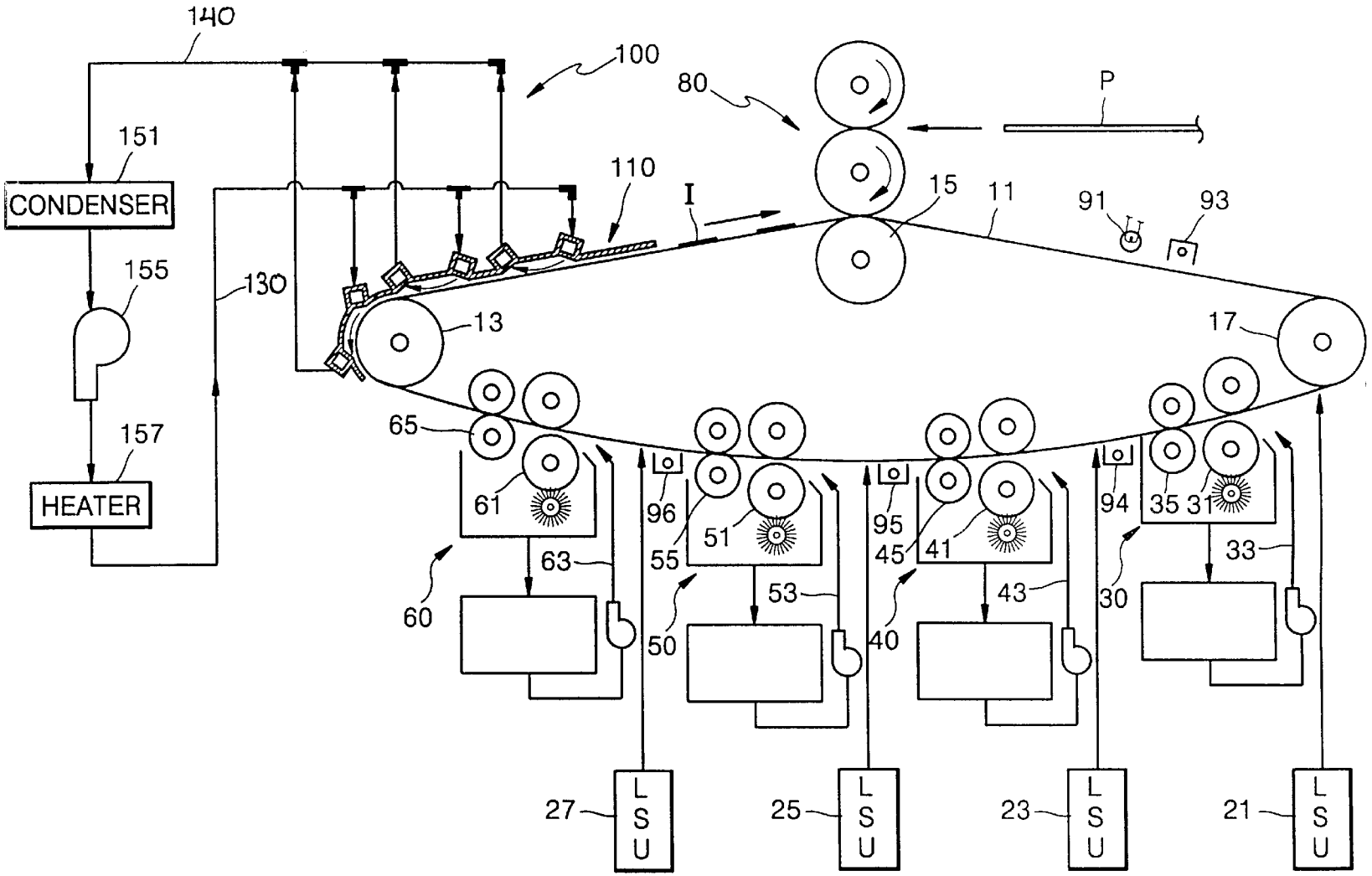
FIG. 2 is a schematic diagram illustrating a liquid electrophotographic printing apparatus equipped with a drying unit for a printing apparatus according to a first embodiment of the present invention.

With reference to FIG. 2, a drying unit 100 for a liquid electrophotographic printing apparatus according to a first embodiment of the invention provided in a liquid electrophotographic printing apparatus comprises developing units 30, 40, 50 and 60 that develop an image on a photosensitive medium using a liquid carrier as a mediator and a transfer unit 80 that transfers this developed image onto a printing paper P, wherein the drying unit dries the liquid carrier remaining on the photosensitive medium after developing. FIG. 2 illustrates for example a photosensitive belt 11 as a photosensitive medium that rotates on a predetermined path by being wound around a driving roller 13, a transfer backup roller 15 and a steering roller 17. This photosensitive medium can of course be comprised of a photosensitive drum (not shown).

Figure 1:
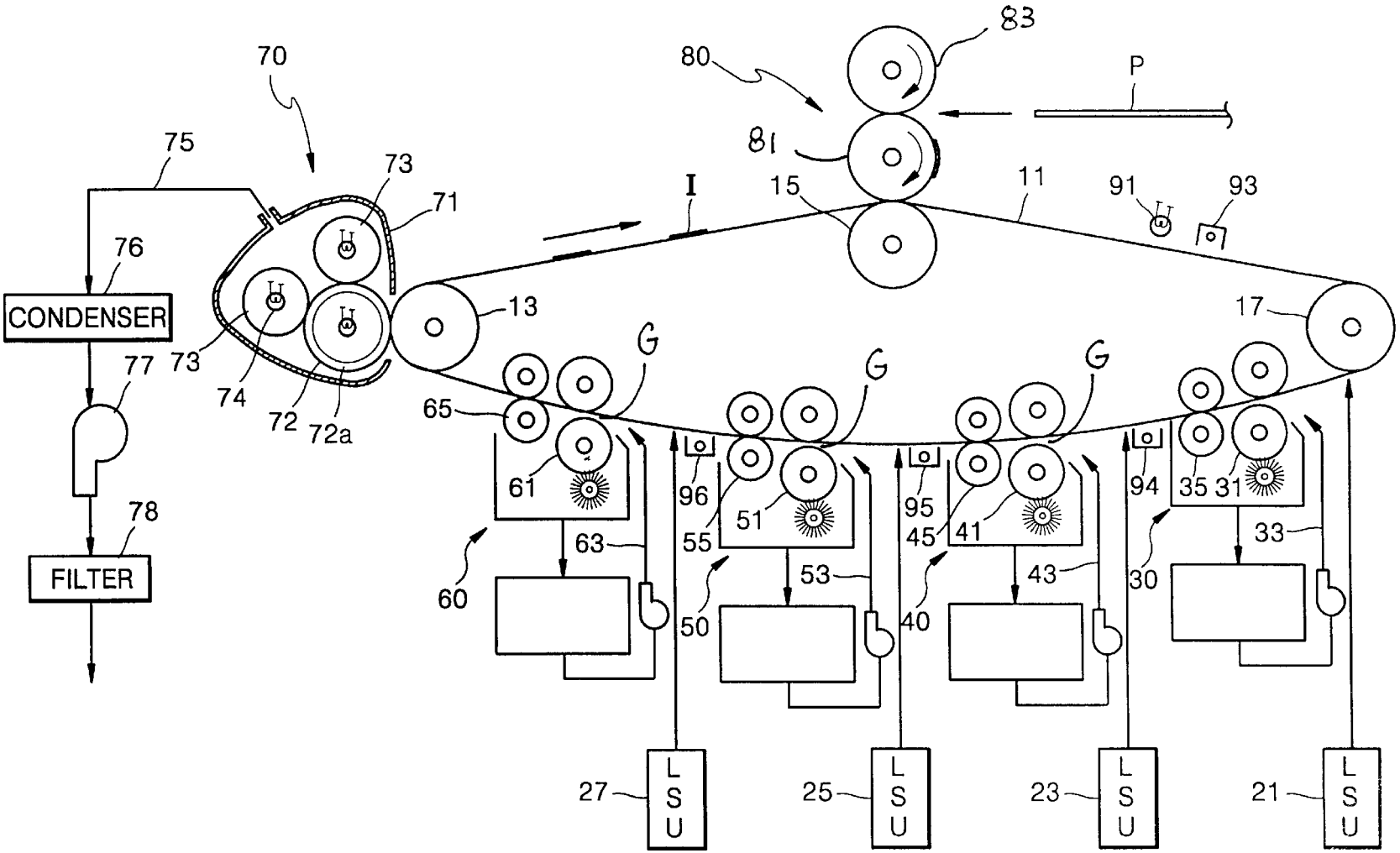
FIG. 1 (PRIOR ART)
FIG. 1 is a schematic diagram illustrating a general liquid electrophotographic printing apparatus equipped with a drying unit for a prior printing apparatus.

In the liquid electrophotographic printing apparatus shown in FIG. 2, the other constituents except the drying unit 100 are essentially the same as those explained with reference to FIG. 1. Therefore, for the constituents that are essentially the same as those disclosed in FIG. 1, the same numbers are used, and the detailed explanation is omitted.

The drying unit 100 according to the first embodiment of the invention is installed in a non-contacting way with the photosensitive belt 11 between the developing units 30, 40, 50 and 60 and the transfer unit 80, and evaporates the liquid carrier remaining on the photosensitive belt 11 after developing an image at the developing units 30, 40, 50 and 60, and thus allows the image transcribed on the printing paper P through the transfer unit 80 to have a predetermined image concentration.

For this purpose, the drying unit 100 comprises a manifold 110 that is positioned near the photosensitive belt 11 with a surface facing the photosensitive belt 11, that is open, an inlet-outlet channel through which gas flows in and out of the manifold 110, a gas flowing means 155 which lets gas in the inlet-outlet channel flow, a condenser 151 and a heater 157 that heats gas flowing in the manifold 110.

The inlet-outlet channel consists of an inlet channel 130 through which gas flows in the manifold 110 and an outlet channel 140 through which gas flows out of the manifold 110. The inlet channel 130 and the outlet channel 140, between which the condenser 151, the gas flowing means 155 and the heater 157 are positioned, are connected to each other. Therefore, the gas flowing out of the manifold 110 passes through the condenser 151, the air flowing means 155, the heater 157 the outlet channel 140, and is re-supplied to the manifold 110 through the inlet channel 130.

The condenser 151 is positioned between the outlet channel 140 and the inlet channel 130, and condenses the carrier discharged through the outlet channel 140. The carrier condensed at this condenser 151 is stored at a state with the water condensed in a storage tank (not shown) through another supply channel (not shown) or is moved to a waste tank (not shown).

The gas flowing means 155 is positioned at a point of a closed path that passes through the inlet-outlet channel, so that gas can be circulated in and out of the manifold. This gas flowing means 155 is to ensure that the gas, which is not condensed at the condenser 151, is re-supplied to the manifold 110 and that the liquid carrier vaporized in the manifold and the supplied gas is discharged. For this purpose, the gas flowing means 155 consists preferably of a gas pump and/or a ventilation fan.

The heater 157 is positioned at a point of the path of the inlet channel and heats the gas flowing in the manifold 110 to a predetermined temperature. The heating temperature of this heater 157 is determined differently according to the amount of the liquid carrier remaining on the photosensitive belt 11. Here, the amount of the liquid carrier is calculated according to image coverage that represents the degree in which an image essentially occupies one image region.

With reference to FIGS. 2–5, the manifold 110 has at least one inlet 123 through which the gas heated by the heater 157 flows in and at least one outlet 127 through which the gas flowing in and the carrier vaporized from the photosensitive belt 11 are discharged. The manifold 10 also comprises a duct 111 that guides the gas stream flowing in through the inlet 123 and cover members 121, 125 for inflow and outflow, which are positioned on the duct 111 where the inlet 123 and the outlet 127 are formed, respectively.

Figure 3:
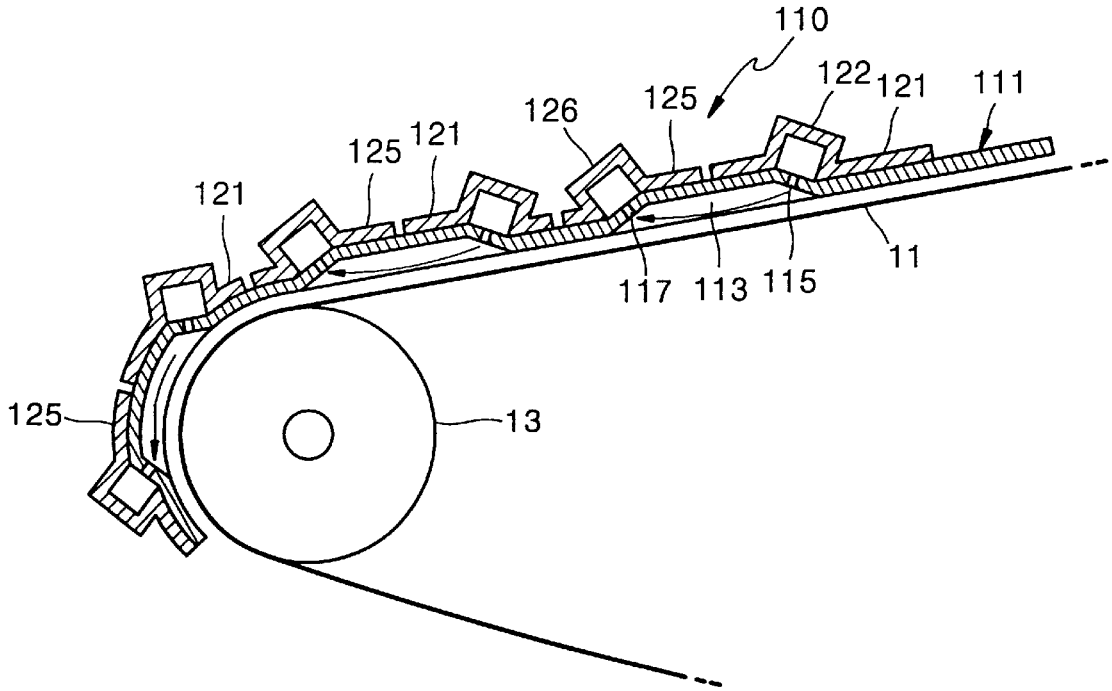
FIG. 3 is a schematic cross-sectional view illustrating a selected part of a drying unit for a printing apparatus according to the first embodiment of the invention.

The duct 111 lets the gas flowing in at the heated state in the heater 157 proceed facing the photosensitive belt 11 to guide the vaporization of the liquid carrier on the photosensitive belt 11, and is equipped with a guiding part 113 that is formed in a protruding way to create a predetermined space inside the duct. Referring to FIG. 3, the guiding part 113 is shaped in such a way that both sides of the guiding part 113 are tilted, and the cover member for inflow 121 and the cover member for outflow 125 are positioned on top of each tilted part. The guiding part 113 is preferably arranged such that the angle between the tilted part of the guiding part 113 and the photosensitive belt 11 is 30–60 degrees. This is to ensure that the gas flowing in through the inlet 123 and flowing into the guiding part faces the photosensitive belt in an obtuse angle.

Figure 4:
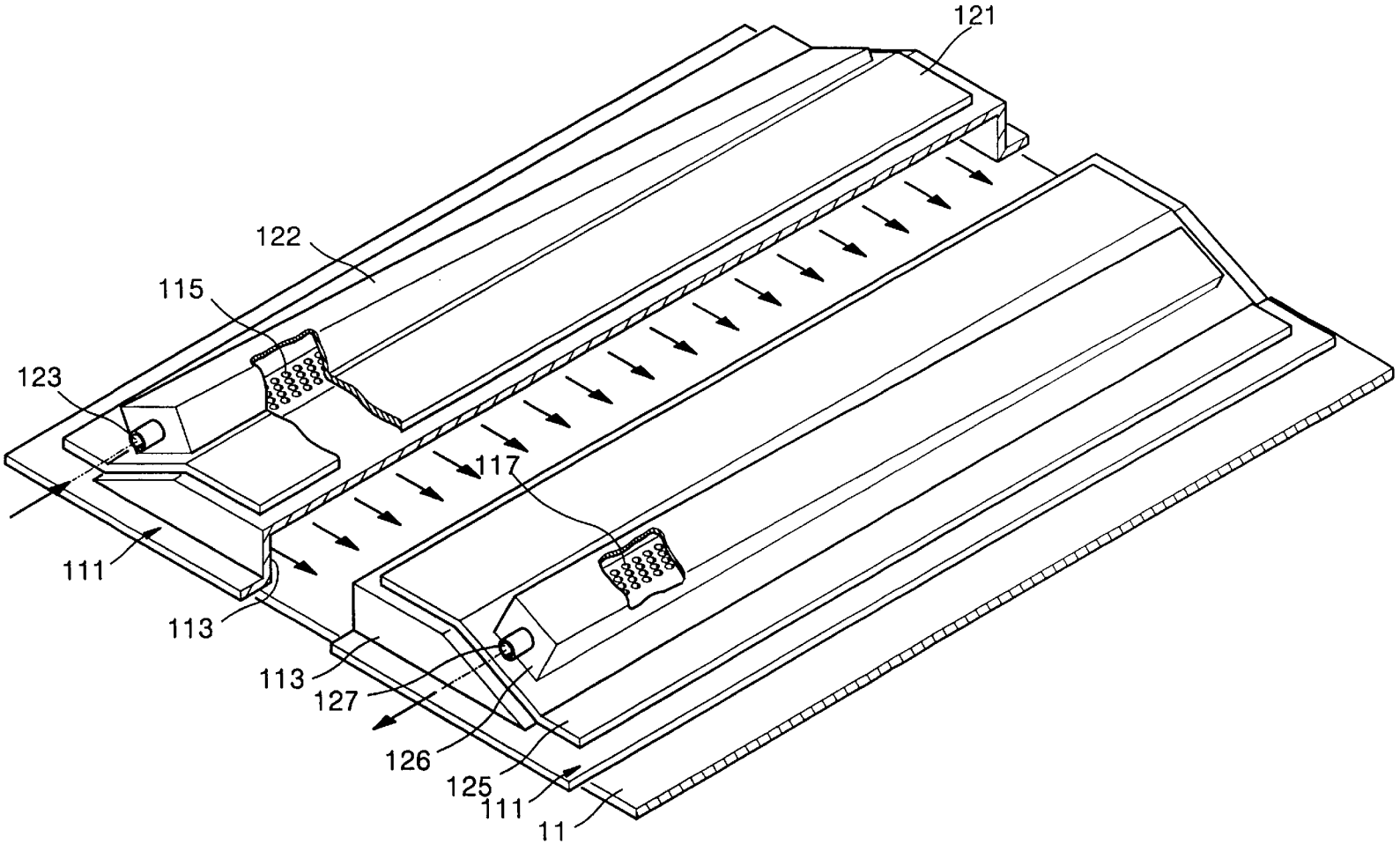
FIG. 4 is a schematic perspective view illustrating a selected part of a drying unit for a printing apparatus according to the first embodiment of the invention.

In a tilted part a first hole 115 leads the gas flowing in through the cover member for inflow 121 into the guiding part 113. In the other tilted part, a second hole 117 leads the gas in such a way that the gas inside the guiding part 113 is discharged at the same speed along the width of the photosensitive belt 11. A plurality of micro-passage holes as shown in FIG. 4 in the shape of the first hole 115 and the second hole 117, and a variety of slits formed long along the width of the photosensitive belt 11 are provided. By providing the plurality of micro-passage holes and slits in this manner, the gas flowing in through the guiding part 113 and the gas discharged from the guiding part 113 can be guided constantly along the width of the photosensitive belt 11. Here, the duct 111 is arranged in such a way that the interval between the photosensitive belt 11 and the duct 111 beside the region of the guiding part 113 is narrow.

Figure 5:
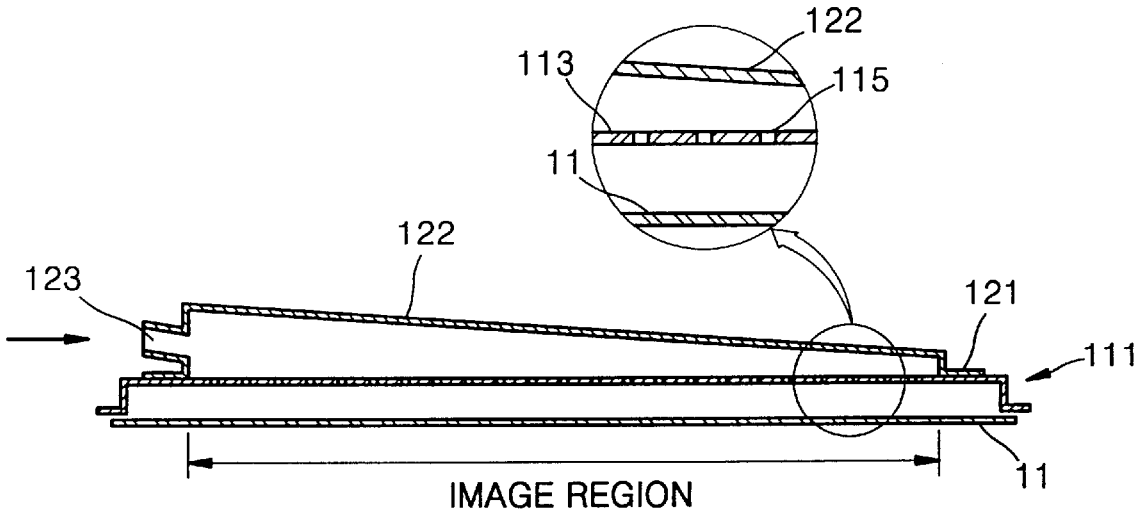
FIG. 5 is a cross-sectional view of FIG. 3.

With reference to FIGS. 4 and 5, the covering member for inflow 121 has a gas supplying part 122 that supplies the guiding part 113 of the duct 111 with the gas flowing in through the inlet 123. This gas supplying part 122 is arranged along the width of the photosensitive belt 11, and is shaped in a tapering way from the inlet 123 to the opposite side. Therefore, the gas that flows in through the inlet 123 and that is directed to the inside of the guiding part 113 is guided constantly along the width of the photosensitive belt 11. In this manner, the liquid carrier can be dried by moving the gas flowing in through the covering member 121 at a predetermined temperature and speed throughout the region larger than the region of the image on the photosensitive belt 11.

The covering member for outflow 125 has a gas discharging part 126 that discharges the gas inside of the guiding part 113 and the evaporated carrier through an outlet 127 installed at an end. This gas discharging part 126 is shaped in a tapering way from the outlet 127 to the opposite side in the same way as in the gas supplying part 122. Therefore, the gas that will be discharged from the guiding part 113 is guided to be discharged at a speed within a predetermined range throughout the whole region.

Meanwhile, one or more of the guiding parts 113, gas supplying parts 122 and the gas discharging parts 126 as described above can be equipped according to the type of photosensitive medium and the kind of a printing apparatus. As shown in FIGS. 2 and 3, in a structure where the photosensitive belt 11 is used as a photosensitive medium and which requires a relatively large drying capacity, a plurality of the guiding part 112, the gas supplying part 122 and the gas discharging part 126 are positioned in the region between the developing units 30, 40, 50 and 60 and the transfer unit 80, thereby improving the drying efficiency.

Here, the covering members 121, 125 for inflow and outflow are preferably arranged in such a way that the gas flowing inside of the guiding part 113 proceeds in the direction opposite to the progression direction of the photosensitive belt 11. In this manner, by making the progression direction opposite to the gas flow direction and increasing the relative speed of the liquid carrier on the photosensitive belt to the gas, the vaporization efficiency of the liquid carrier can be improved.

Figure 6:
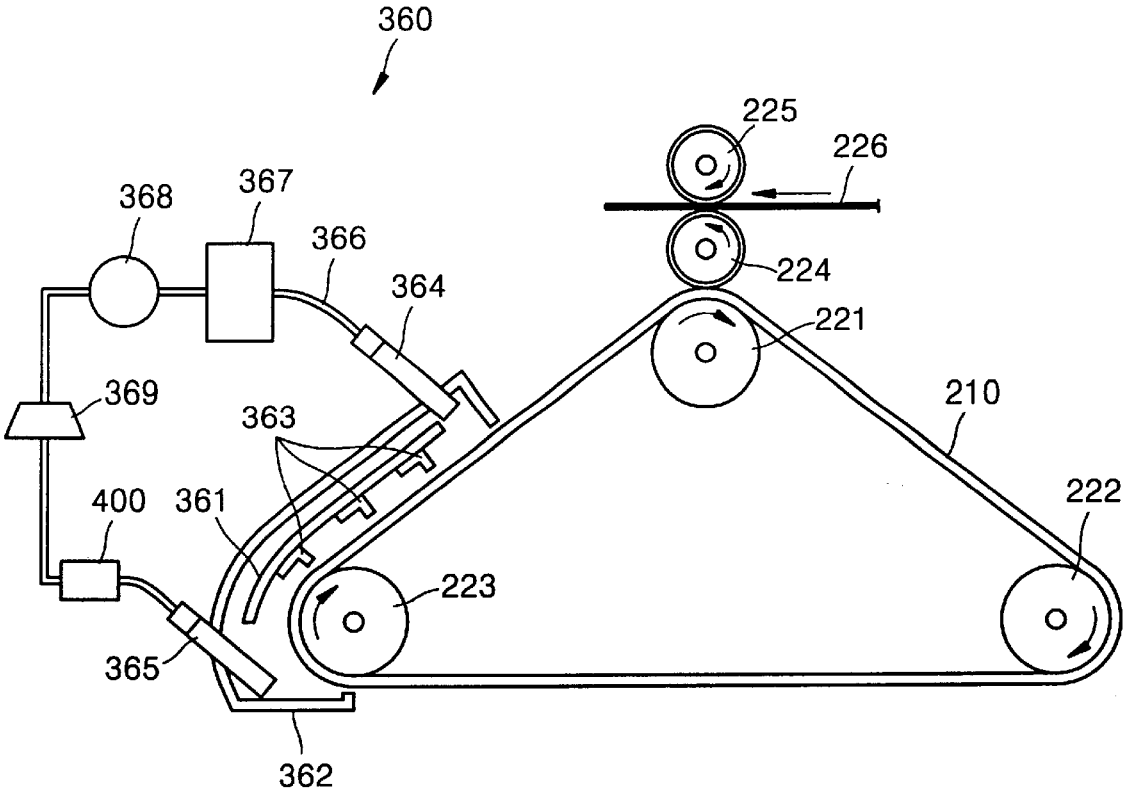
FIG. 6 is a schematic diagram illustrating the configuration of a drying unit for a liquid electrophotographic printing apparatus according to the second embodiment of the invention.
Figure 7:
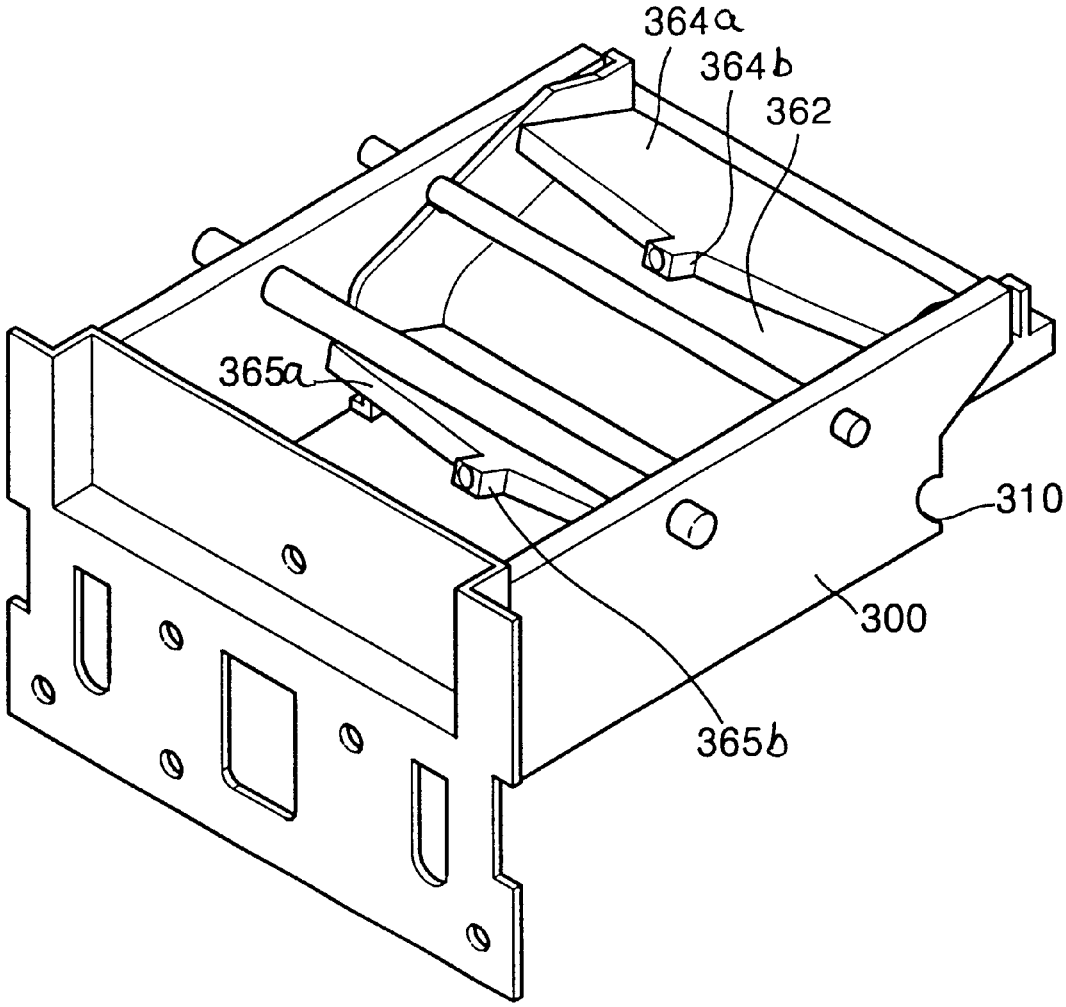
FIG. 7 is a perspective view illustrating the construction of an inlet duct and a ventilation duct of a drying unit for a liquid electrophotographic printing apparatus shown in FIG. 6.
Figure 8:
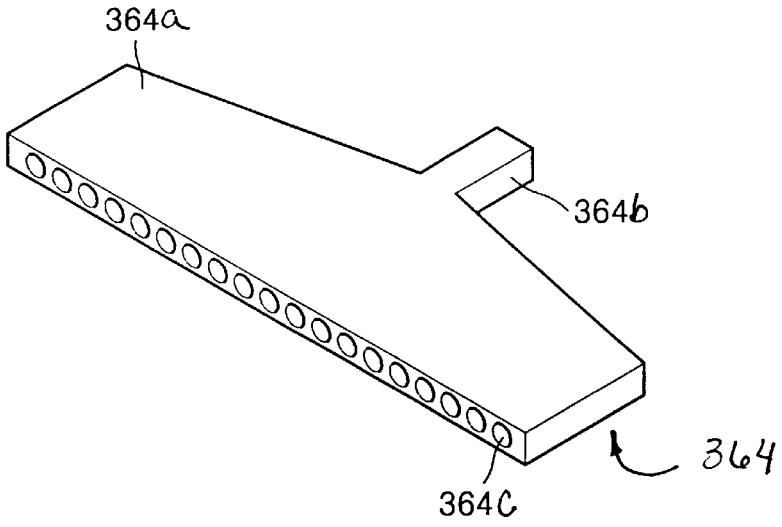
FIG. 8 is a perspective view illustrating an inlet duct of a photosensitive belt drying unit for a liquid electrophotographic printing apparatus shown in FIG. 6.

FIG. 6 is a schematic diagram illustrating the configuration of a drying unit for a liquid electrophotographic printing apparatus according to a second embodiment of the invention; FIG. 7 is a perspective view illustrating the construction of an inlet duct and a ventilation duct of a drying unit for a liquid electrophotographic printing apparatus shown in FIG. 6; and FIG. 8 is a perspective view illustrating an inlet duct of a photosensitive belt drying unit for the liquid electrophotographic printing apparatus shown in FIG. 6.

Referring to FIG. 6, a drying unit 360 for a liquid electrophotographic printing apparatus according to a second embodiment of the present invention comprises a heating means 361 that generates heat to evaporate a liquid carrier wetting the surface of the photosensitive belt 210; a manifold 362 that surrounds the heating means 361, an inlet-outlet channel 366 that forms a closed loop in communication with the manifold 362; an inlet duct 364 and a ventilation duct 365 that are installed in the manifold 362 in communication with the inlet-outlet channel 366; and a gas flowing means 369 that makes the gas carrier circulate along the inlet-outlet channel.

The heating means 361 has a predetermined length without contacting the photosensitive belt 210 and is installed along the width of the photosensitive belt 210. The heat generated at the heating means 361 allows the air flowing in through the ventilation 365 duct to keep a constant temperature without cooling down. If the temperature of the air reduces down below a certain temperature, the temperature is increased to a higher temperature in order to evaporate the liquid carrier wetting the surface of the photosensitive belt 210. The heating means is preferably a rubber heater in the second embodiment of the invention.

Meanwhile, angled members 363 are installed in a constant interval on the heating means 361. The angled members 363 have a certain height from the photosensitive belt 210 and thus block the air stream that is ventilated through the ventilation duct 365. Therefore, a turbulent flow is formed in the air which is being blocked by the angles of the angled members 363, and this turbulent flow lets the liquid carrier wetting the surface of the photosensitive belt 210 vaporize more easily. Hence, the efficiency of the liquid carrier vaporization increases by installing the angled members 363 on the heating means 361. The angles of the angled members 363 can also be modified as long as their structure blocks the air stream and forms a turbulent flow.

With reference to FIG. 8, the inlet duct 364 is equipped with a base 364*a* prepared to have a certain space, an inlet opening 364*b* positioned in one side of the base 364*a* and in communication with the inlet-outlet channel, and a plurality of holes 364*c* positioned in the other side of the base in a certain interval.

The other side of the base 364*a*, where the holes are formed, is installed in the manifold 362 along the width of the photosensitive belt 210 and the gas carrier collected in the manifold 362 is constantly absorbed into the base 364.

The inlet duct 364 is preferably installed on the top side of the manifold 362 so that the air flowing in the manifold 362 through the ventilation duct 365 and the gas carrier vaporized on the photosensitive belt 210 is more efficiently absorbed.

The configuration of the ventilation duct 365 is the same as that of the inlet duct 364, though the length from the outlet opening 365*b* of the ventilation duct 365 to the holes 365*c* and the space volume of the base 365*a* can be modified such that the air flowing over the surface of the photosensitive belt 210 though the ventilation duct 365 has a same flow speed along the width of the photosensitive belt. That is, the amount of air flowing in the manifold 362 through the ventilation duct 365 can be controlled by adjusting the volume and the length of the base 365*a* of the ventilation duct 365.

On the inlet-outlet channel 366 is installed a condenser 367 that lowers the concentration of the gas carrier, having a high temperature and concentration, which is collected through the inlet duct 364. By reducing the temperature and filtering the gas carrier using a filter 368 that absorbs the remaining carrier passed through the condenser 367, the concentration is reduced.

Also, a separate heating source 400 from the heating means 361 is installed on the inlet-outlet channel 366 that heats the air entering the ventilation duct 365, thus increasing the air temperature. If the air temperature increases, the temperature inside the manifold 362 increases, thus facilitating the vaporization of the liquid carrier in the photosensitive belt 210.

Referring to FIG. 7, the drying unit 360 is installed in a base frame 300. The base frame 300 includes a support 310 that supports the driving roller 223 of the photosensitive belt 210 by a moving means (not shown). Therefore, in the printing mode, the drying unit 360 is proximate to the photosensitive belt 210 so that the driving roller 223 of the photosensitive belt 210 connects to the support 310 of the base frame 300. In the stop mode or the standby mode, the drying unit 360 is separated from the photosensitive belt by a moving means (not shown).

The operation of the drying unit for a liquid electrophotographic printing apparatus according to the present invention configured, as described above, is explained with reference to the drawings.

In the printing mode, when the photosensitive belt 210 circulates by being wound around the driving roller 223, the heating means 361 generates heat. This heat evaporates the liquid carrier wetting the surface of the photosensitive belt 210. At the same time, the gas flowing means 369 starts to operate, thus forcing the air to flow along the inlet-outlet channel 366. Hence, air enters the manifold 362 from the ventilation duct 365 that is installed at the bottom of the manifold 362.

The stream of the air entering the manifold 366 is blocked by a plurality of angled members 363 that are installed on the heating means 361, and a turbulent flow of air is formed. This turbulent flow promotes the vaporization of the liquid carrier wetting the surface of the photosensitive belt 210.

The gas carrier vaporized from the photosensitive belt 210 stays temporarily in the manifold 362 and then enters the inlet duct 364 through the holes 364*c* that are formed in the inlet duct 364.

The gas carrier passing through the inlet duct 364 is at a high temperature and concentration, and its temperature is decreased and its concentration lowered as it passes through the condenser 367. At this time, the carrier is recycled by a carrier recycling unit not shown in the drawings.

As the gas carrier passes through the condenser 367 and then through the filter 368, the remaining carrier is filtered so that it will have a concentration that is low enough to satisfy environmental standards.

The heating source 400 is further installed between the filter 368 and the ventilation duct 365 and increases the temperature of the air passing through the filter 368, blowing the air into the manifold 362. In this manner, the increasing of the air temperature facilitates the vaporization of the liquid carrier from the photosensitive belt 210.

Here, the amount of air stream is about 100 liters/min and the temperature of the air blowing in through the ventilation duct 364 and the air blowing in the inlet duct 365 is about 100° C. These conditions can obtain the drying condition for evaporating the liquid carrier. Here the temperatures should be preferably maintained to an appropriate level because the temperature of the printing apparatus itself increases if the temperatures become too high.

In addition, by controlling the amount of air stream in the inlet duct 364 and the ventilation duct 365, an optimal drying condition can be obtained.

Figure 9:
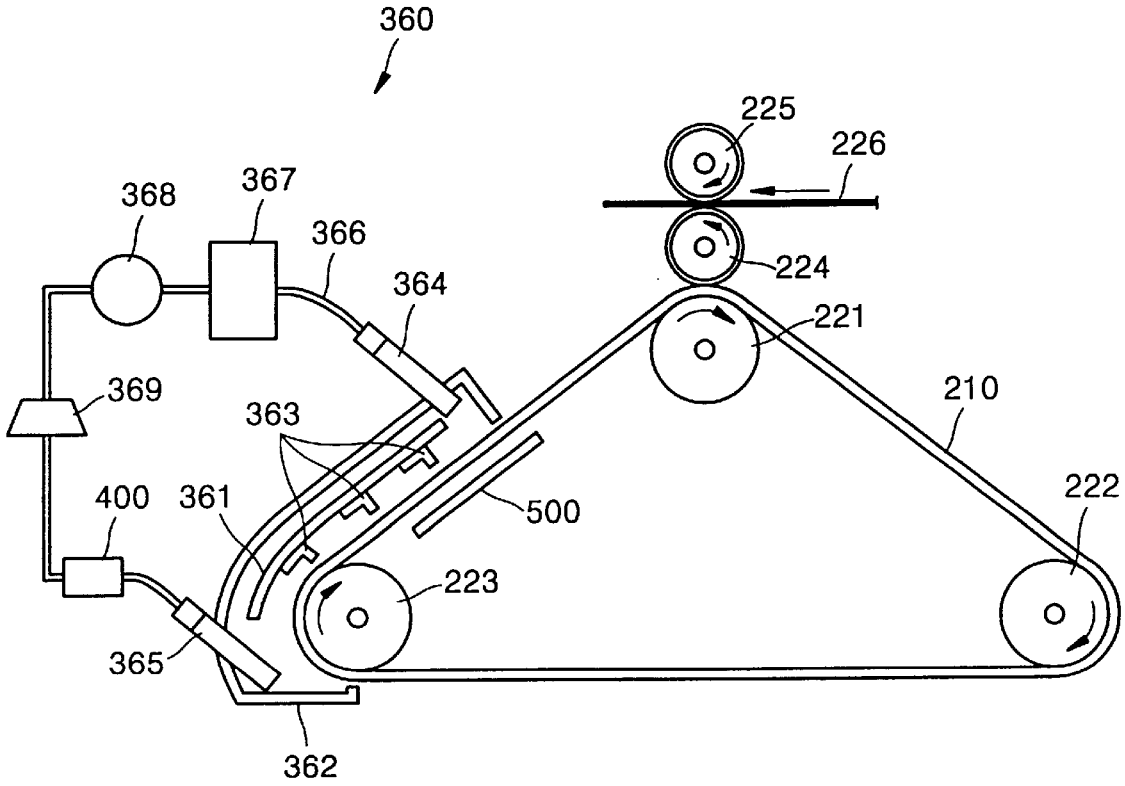
FIG. 9 is a schematic diagram illustrating the configuration of a drying unit for a liquid electrophotographic printing apparatus according to a third embodiment of the invention.

FIG. 9 is a schematic diagram illustrating the configuration of a drying unit for a liquid electrophotographic printing apparatus according to a third embodiment of the invention.

With reference to FIG. 9, the drying unit for the liquid electrophotographic printing apparatus according the third embodiment of the invention is configured in the same way as the drying unit according to the second embodiment shown in FIG. 6, though a separate heating means 500 is installed at the back of the photosensitive belt 210.

Therefore, the separate heating means 500 increases the amount of heat transferred to the photosensitive belt, thus promoting the vaporization of the liquid carrier.

Below, a liquid carrier drying method using the drying unit for the liquid electrophotographic printing apparatus according to the first preferred embodiment of the invention is explained in detail The liquid carrier drying method according to the first embodiment of the invention can, in its feature, elevate the drying efficiency of the drying unit for the liquid electrophotographic printing apparatus explained with reference to FIGS. 2–4. Here for the convenience of explanation, a liquid carrier drying method according to the first embodiment is explained, but it applies to the second embodiment and the third embodiment as well.

Figure 10:
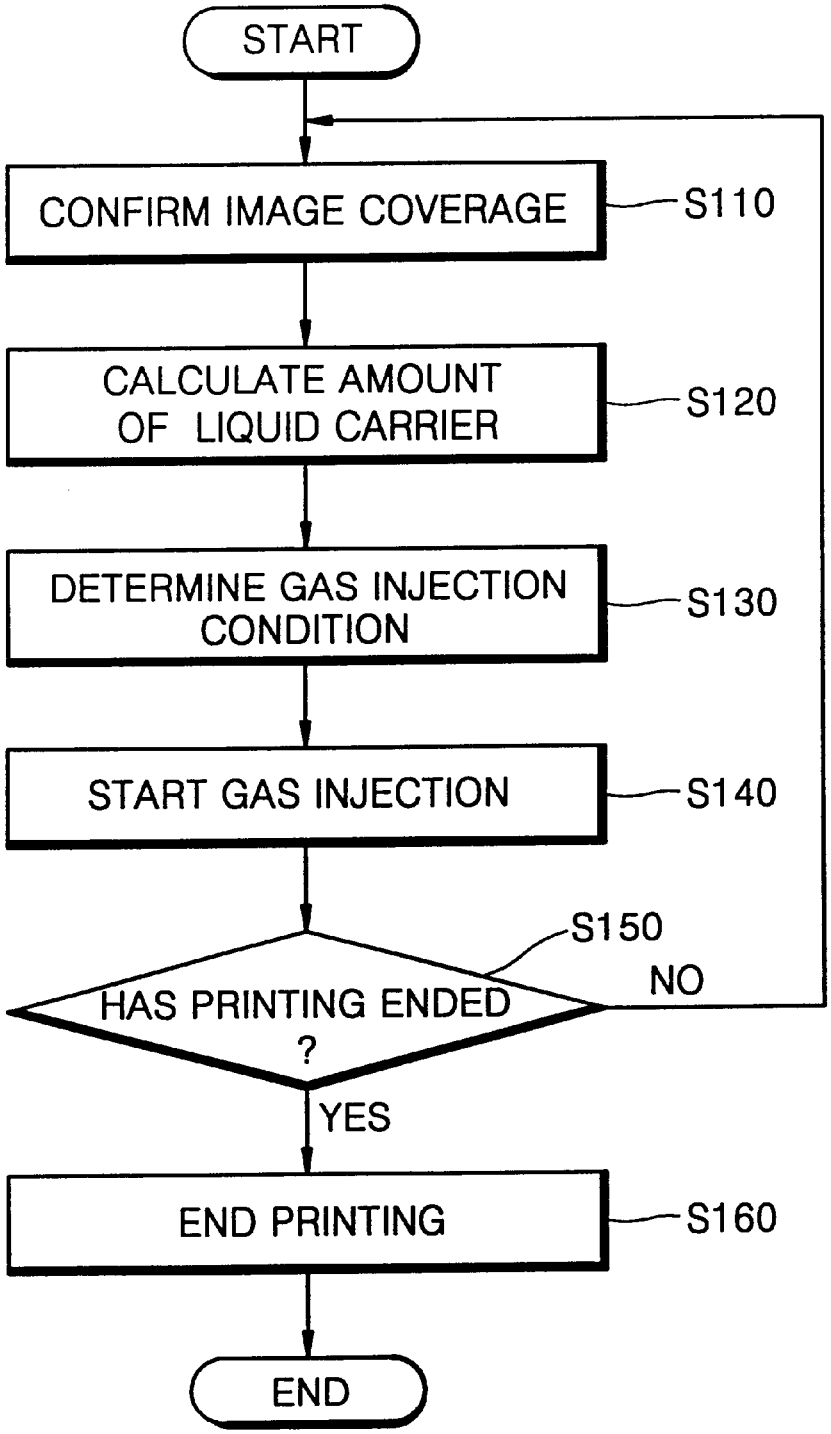
FIG. 10 is a flow chart explaining a liquid carrier drying method using a drying unit for a liquid electrophotographic printing apparatus according to the invention.

With reference to FIGS. 2 and 10, the liquid carrier drying method comprises the steps of calculating the amount of the liquid carrier on the photosensitive belt 11 and of determining the gas injection condition according to the calculated amount of the liquid carrier and a step S140 of starting gas injection.

Subdividing the calculation of the liquid carrier and the gas injection condition gives a step S110 of confirming image coverage, a step S120 of calculating the amount of the liquid carrier according to the confirmed image coverage, and a step S130 of determining the gas injection condition based on the calculated amount of the liquid carrier. The image coverage is a value that can be obtained from the image data which will be printed and the amount of the liquid carrier remaining on the photosensitive belt 11 is determined according to this image coverage. Therefore, by making data of the relationship between this image coverage and the liquid carrier by experiment, the amount of the liquid carrier can be calculated according to the image coverage. The gas injection determining step S130 is a step of determining the heating temperature of the heater 157 and the gas injection speed suitable for the amount of the liquid carrier calculated as above.

For example, in the case of having 5% image coverage, the image has a 55% degree of drying after passing through the developing units 30, 40, 50 and 60. In order to make this an image having a 90% degree of drying that can be easily transcribed in the transfer unit 80, in the case of a drying unit having the structure of three inlets and outlets as shown in FIG. 2, gas at 60° C.–90° C. is injected at the inlets at a speed of 30–50 liters/min.

As described above, after the gas injection condition is determined (S130), the gas injection is started (S140). In other words, the injection gas is heated using the heater according to the determined gas injection condition. This heated gas is injected at a predetermined speed into the manifold 110 positioned near the photosensitive medium with the surface facing the photosensitive medium open and the liquid carrier on the photosensitive medium 11 being evaporated. Subsequently, the carrier vaporized from the photosensitive belt 11 and the gas flowing in are discharged outside of the manifold 111 through the inlet-outlet channel. Later, the vaporized carrier discharged from the manifold 111 is condensed, and the remaining gas that is not condensed is reheated and injected to the manifold at a predetermined speed.

In this manner, it is determined selectively whether the gas injection step S140 will be performed or ended according to the condition that printing ends or not (S150). In other words, when printing is concluded to end in the step S150 of determining whether printing will end or not, the gas injection ends by stopping gas injection and heating at the drying unit (S160). Meanwhile, when printing continues, the steps S110, S120 and S140 are performed in order, and the carrier on the photosensitive belt is vaporized. In this manner, by evaporating the liquid carried on the photosensitive belt, the drying degree of an image suitable for the transfer unit can be achieved.

Therefore, the drying unit for the liquid electrophotographic printing apparatus according to the present invention achieves the objectives as indicated below.

Firstly, it makes a normally expendable drying unit in the liquid electrophotographic printing apparatus semi-permanent, thus allowing the drying unit to be used for more than its usual lifetime, which can in turn greatly improve the competitiveness of a product.

Secondly, it solves the picking phenomena since the drying unit does not contact the photosensitive belt and it improves the image quality since the image is not adversely affected by the phenomena.

Lastly, it obtains an optimal transfer image by suitably varying air temperature and flow amount at various image coverages.

At the same time, the liquid carrier drying method using the drying unit for the liquid electrophotographic printing apparatus according to the examples of the present invention can improve the drying efficiency by optimizing heating temperature and gas flow as well as the number of the guiding parts, gas supplying parts and gas discharging parts, according to the amount of the liquid carrier on the photosensitive medium.

What is claimed is:

1. A drying unit for a liquid electrophotographic printing apparatus equipped in the printing apparatus comprising a developing unit that develops an image on a photosensitive medium using a liquid carrier as a mediator and a transfer unit that transcribes the developed image on a printing paper, so that the liquid carrier remaining on the photosensitive medium can be dried, and a drying unit comprising:

a manifold having at least one inlet which is positioned near the photosensitive medium with a face opposite to the photosensitive medium open and through which hot air flows in, and at least one outlet through which a carrier evaporated from the photosensitive medium by the hot air flowing in is discharged;

an inlet-outlet channel connecting the inlet to the outlet;

a gas flowing means by which a gas in the manifold is discharged through the outlet and by which gas flows in the manifold through the inlet;

a condenser that is positioned on the inlet-outlet channel and that condenses the evaporated carrier discharged through the outlet; and a heater that is located on the inlet-outlet channel and that heats the gas flowing in the manifold through the inlet.

2. The drying unit for the liquid electrophotographic printing apparatus according to claim 1, wherein the manifold is positioned between the developing unit and the transfer unit, thereby causing the liquid carrier remaining on the photosensitive medium after developing at the developing units to be evaporated.

3. The drying unit for the liquid electrophotographic printing apparatus according to claim 1, wherein the manifold further comprises:

a duct that directs the gas flowing in at the heated state to flow along a surface of the photosensitive medium to guide the vaporization of the liquid carrier on the photosensitive medium;

a first covering member for inflow that is positioned on the duct and that has a gas supplying part that is operable as a first guiding part of the duct for the gas flowing in through an inlet installed in an end of said first covering member; and a second covering member for outflow that is positioned on the duct and that has a gas discharging part that is operable for discharging the gas inside of a second guiding part and the carrier evaporated from the photosensitive medium through an outlet installed at an end of said second covering member.

4. The drying unit for the liquid electrophotographic printing apparatus of claim 3, wherein the gas supplying part of the first covering member for inflow of the gas is shaped in a tapering way, so that the amount of the gas which flows in through the inlet and which flows toward the first guiding part is constant along the width of the photosensitive medium.

5. The drying unit for the liquid electrophotographic printing apparatus of claim 3, wherein at least one of a plurality of passage holes and at least one of a plurality of slits are provided in a side of the first guiding part of the duct facing the gas suppling part, so that the amount of the gas flowing into the first guiding part is constant along the width of the photosensitive medium.

6. The drying unit for the liquid electrophotographic printing apparatus of claim 3, wherein the gas discharging part of the second covering member for outflow having a tapered shape, so that the gas inside of the second guiding part is discharged constantly along the width of the photosensitive medium.

7. The drying unit for the liquid electrophotographic printing apparatus of claim 3, wherein at least one of a plurality of passage holes and at least one of a plurality of slits are provided in a side of the second guiding part of the duct facing the gas discharging part, so that the amount of the gas discharged from the second guiding part is constant along the width of the photosensitive medium.

8. The drying unit for the liquid electrophotographic printing apparatus of claim 3, wherein the first and second covering members for inflow and outflow are arranged to cause gas flowing inside of the first and seconds guiding part to proceed in the direction opposite to the progression direction of the photosensitive belt.

9. The drying unit for the liquid electrophotographic printing apparatus of claim 1, wherein the gas flowing means is positioned on the inlet-outlet channel and comprises at least one of an air pump and a ventilation fan.

10. A drying unit for a liquid electrophotographic printing apparatus, the unit comprising:

a heating means that is installed in parallel to the running direction of a photosensitive belt out of contact with the photosensitive belt and that generates heat in order to dry and evaporate the liquid carrier directly from the photosensitive belt;

a manifold that surrounds the heating means and that collects the gas carrier evaporated by the heating means;

an inlet-outlet channel that forms the path for circular movement of the gas carrier collected in the manifold by forming a closed loop in communication with the manifold;

at least one gas flowing means which is installed on the inlet-outlet channel and by which the gas carrier is circulated along the inlet-outlet channel;

an inlet duct which is installed in the manifold and through which the gas carrier evaporated by the heating means flows in communication with the inlet-outlet channel; and a ventilation duct which is installed in communication with the inlet-outlet channel so that air flows in the manifold.

11. The drying unit for the liquid electrophotographic printing apparatus of claim 10, wherein the heating means is a rubber heater.

12. The drying unit for the liquid electrophotographic printing apparatus of claim 10, wherein a plurality of angled members are further installed in a constant interval on a surface of the heating means, so that a turbulent flow is formed in the air entering the manifold through the ventilation duct.

13. The drying unit for the liquid electrophographic apparatus of claim 12, wherein the angled members block at least a portion of the air entering the manifold causing said turbulent air flow.

14. The drying unit for the liquid electrophotographic printing apparatus of claim 10, wherein the inlet duct is equipped with an inlet opening that is in communication with the inlet-outlet channel and a base that is prepared to have a certain space with one side of the base connected to the inlet opening, and a plurality of holes that are positioned in the other side of the base in a certain interval along the width of the photosensitive belt, so that the gas carrier vaporized from the photosensitive belt can be constantly absorbed.

15. The drying unit for the liquid electrophotographic printing apparatus of claim 14, wherein the inlet duct is installed on a top side of the manifold so that the gas carrier vaporized from the photosensitive belt can be easily absorbed.

16. The drying unit for the liquid electrophotographic printing apparatus of claim 15, wherein the ventilation duct is installed at a bottom of the manifold, so that the air flowing toward the inlet duct contributes to the collection of the gas carrier vaporized from the surface of the photosensitive belt.

17. The drying unit for the liquid electrophotographic printing apparatus of claim 10, wherein the ventilation duct is equipped with an outlet opening that is in communication with the inlet-outlet channel and a base that has a space with one side of the base connected to the outlet opening, and a plurality of holes that are positioned in the other side of the base in a certain interval along the width of the photosensitive belt, so that the gas flowing along the inlet-outlet channel is ventilated at a constant stream speed.

18. The drying unit for the liquid electrophotographic printing apparatus of claim 10, wherein a condensing means that is installed on the inlet-outlet channel for cooling and condensing the circulating gas carrier is further included.

19. The drying unit for the liquid electrophotographic printing apparatus of claim 10, wherein a filter that is installed on the inlet-outlet channel for separating the liquid carrier which is condensed by the condensing means is further included.

20. The drying unit for the liquid electrophotographic printing apparatus of claim 10, wherein a heating source that is installed on the inlet-outlet channel for increasing the temperature of the air entering the manifold through the ventilation duct to a certain temperature is further included.

21. The drying unit for the liquid electrophotographic printing apparatus of claim 10, wherein a heater that is installed at the back of the photosensitive belt to provide heat for evaporating the liquid carrier wetting the surface of the photosensitive belt is further included.

22. A liquid carrier drying method using a drying unit for a liquid electrophotographic printing apparatus provided in the printing apparatus comprising a developing unit that develops an image on a photosensitive medium using a liquid carrier as a mediator and a transfer unit that transcribes the developed image on a printing paper, so that the liquid carrier remaining on the photosensitive medium can be dried, the drying method comprising the steps of:

calculating the amount of the liquid carrier on the photosensitive medium and determining an air injection condition according to the calculated amount of the liquid carrier;

heating injection air according to the determined condition and evaporating the carrier on the photosensitive medium by injecting the heated gas at a predetermined speed in a manifold positioned near the photosensitive medium a the surface facing the photosensitive medium open;

discharging out of the manifold the carrier evaporated from the photosensitive medium and the gas flowing in through the inlet-outlet channel; and condensing the evaporated carrier at the manifold, reheating the gas that is not heated and injecting the reheated gas at a predetermined speed into the manifold.

23. The liquid carrier drying method of claim 22 using the drying unit for the liquid electrophotographic printing apparatus, wherein the calculation of the amount of the liquid carrier and the determination of the gas injection condition are based on determining the heating temperature in the heater according to image coverage of an image developed on the photosensitive medium and the heated gas injection speed.

24. A method of drying a liquid carrier used in a liquid electrophotographic printing apparatus, comprising the steps of:

developing an image on a photosensitive medium using a liquid carrier as a mediator;

transcribing the developed image on a printing paper so that the liquid carrier remaining on the photosensitive medium can be dried;

injecting hot air at least one inlet in an end of a manifold that runs parallel to the printing medium without contacting said photosensitive medium.

evaporating said liquid carrier using a flow of hot air injected into said manifold;

discharging the evaporated liquid carrier and hot air from the manifold using at least one outlet in an end of said manifold;

condensing said evaporated liquid carrier discharged from said outlet;

heating the air discharged from said manifold; and re-injecting said heated air back to said manifold for further drying.

* * * * *